United States Patent [19]

McLaren

[11] Patent Number: 4,767,242

[45] Date of Patent: Aug. 30, 1988

[54] ROOF TRUSS SLING

[75] Inventor: Raymond J. McLaren, Tamworth, Australia

[73] Assignee: Gary I. Zamel, Randwick, Australia; a part interest

[21] Appl. No.: 901,051

[22] Filed: Aug. 26, 1986

[30] Foreign Application Priority Data

Sep. 3, 1985 [AU] Australia ..... PH02257

[51] Int. Cl.[4] ..... E21D 21/00

[52] U.S. Cl. ..... 405/288; 405/259; 299/11

[58] Field of Search ..... 405/259, 288; 299/11; 24/19, 23 W, 68 R, 115 A, 265 A, 703

[56] References Cited

U.S. PATENT DOCUMENTS

| | | | |
|---|---|---|---|
| Re. 14,482 | 6/1918 | Rothermel | 24/23 W |
| 1,345,806 | 7/1920 | Ornston | 24/23 W |
| 1,726,896 | 9/1929 | Mraz | 24/23 W |
| 3,163,012 | 12/1964 | Dempsey | 405/259 |
| 4,265,571 | 5/1981 | Scott | 405/288 X |
| 4,456,405 | 6/1984 | Galis | 405/288 |
| 4,466,535 | 8/1984 | Huson | 24/23 W X |
| 4,566,378 | 1/1986 | Fleissner | 24/23 W X |
| 4,596,496 | 6/1986 | Tyrell et al. | 405/288 |
| 4,632,605 | 12/1986 | Tucker | 405/288 X |

*Primary Examiner*—Randolph A. Reese
*Assistant Examiner*—John A. Ricci
*Attorney, Agent, or Firm*—Morton J. Rosenberg

[57] ABSTRACT

A roof truss sling having an open ended sleeve which has a wire strand passed through it and attached to bolts fixed in the mine roof. The sleeve is distorted so as to simultaneously crimp the sleeve to the wire strand and also shorten its length. The shortening of the length of the sleeve applies a tensile force between the roof bolts through the wire strand. This tensile force serves to compress the mine roof material and thus acts to truss the mine roof.

14 Claims, 1 Drawing Sheet

ROOF TRUSS SLING

This invention relates to roof trusses for mines. In order to truss the roof of mines it has been known to apply compression to the roof material and thus make the material self supporting.

In the past, steel structural members were used to apply these compressive forces to the roof material. These methods were complicated, difficult to adjust and expensive. Other methods included the use of elongated bolt arrangements wherein compressive forces are applied to the roof material by the use of turnbuckles attached between two elongated bolts or rods. These arrangements are difficult to fit and adjust in that the rods or bolts are inflexible. Furthermore, they have finite limitations to their adjustment due to their fixed length, the amount of threading provided and the adjustment length of the turnbuckle. Furthermore such arrangements are expensive and complex.

The present invention seeks to overcome these problems by providing a simple sling device which when attached to the mine roof applies a compressive force and thus acts as a truss. It uses common inexpensive materials and provides a system which is quick to adjust, fit and tension.

According to one aspect, the present invention consists of a roof truss sling for use in mines comprising, at least one flexible tension member adapted to engage at least two spaced mounting devices fixed in a mine roof, an open ended sleeve adapted to receive said flexible tension member, said sleeve being able to be distorted in use such that said tension member is fixedly engaged within the said sleeve and such that its ends are drawn closer together by said distortion so as to apply a tensile force between said mounting devices.

According to a further aspect, the present invention consists of a method of trussing the roofs of mines comprising the following steps:

feeding at least one flexible tension member through an open ended sleeve, engaging said flexible tension member with at least two spaced mounting devices fixed in a mine roof, distorting said sleeve such that said tension member is fixedly engaged within said sleeve and the ends of said sleeve are drawn closer together by said distortion so as to apply a tensile force between said mounting devices.

In a preferred embodiment two flexible tension members are used and are formed by wire strands which are looped through U-shaped pipes for engaging spaced roof bolts in the mine rood. These pipes serve to hold a 180° bend in each strand and to protect the strand where it engages the roof bolts.

The ends of the respective strands are then fed through opposite ends of a rolled hollow section sleeve. The sleeve and the strands contained within it are then bent by applying oppositely directed transverse bending forces by any suitable means. Preferably the sleeve is bent into a wave pattern. As the bending of the sleeve is commenced the strands inside are pinched so that they can no longer move relative to the sleeve. When the pattern of wave bending is complete the ends of the sleeve have been drawn closer together such that the assembly is shorter than when first pinched. Since the ends of the sling are fixed at the roof bolts, this shortening creates tension in the sling. The tension created is a function of the force used to create the bends in the sleeve.

A preferred embodiment of the invention will now be described, by way of example only, with reference to the accompanying drawings in which.

Figure 1:
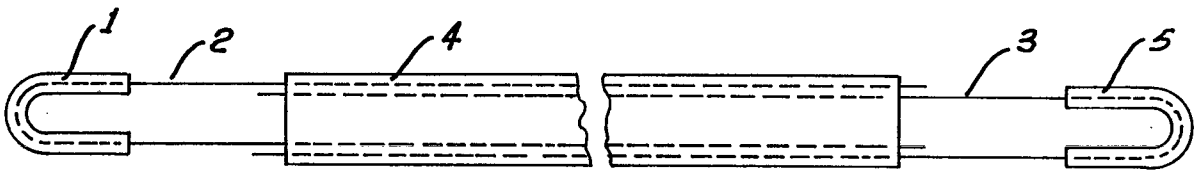
FIG. 1 shows an unattached sling according to the invention.

Referring to the drawings, FIG. 1 shows the sling arrangement before it is mounted on the mine roof. U-shape mounting pipes 1 and 5 are used to facilitate engagement of the wire strands 2 and 3 to their associated roof bolts. The strand ends are passed through a rolled hollow section sleeve 4. The arrangement is readily adjustable since the wire strands are slidable through the sleeve.

Figure 2:
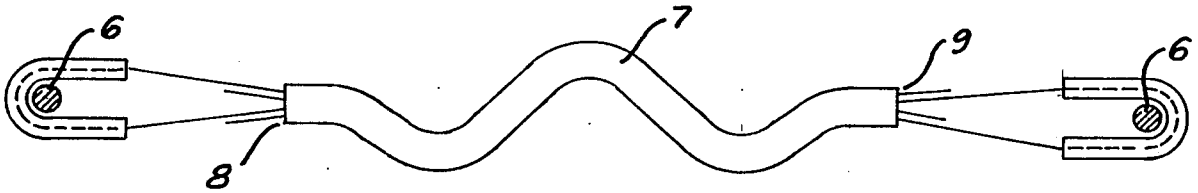
FIG. 2 shows the sling of FIG. 1 in its fitted state.

In use, as shown in FIG. 2, the mounting pipes are engaged with roof bolts 6 in either side of the mine roof and the wire strands 2 and 3 are adjusted as tightly as possible. The sleeve is then bent by a suitable tool into a wave shape 7. This bending results in the wire strands 2 and 3 being crimped within the sleeve. At the same time, the opposite ends 8 and 9 of the sleeve are drawn closer together. This creates tension between the bolts 6 thereby applying a compressive force to the mine roof material between these bolts.

It will be understood that a variety of other embodiments of the invention are possible without departing from the spirit or scope of the invention. For example, in order to compress a larger area of mine roof it would be possible to use a number of wire strands attached to a number of bolts, all fed through a common sleeve.

I claim:

1. A roof truss sling for use in mines comprising: at least one flexible tension member adapted to engage at least two spaced mounting devices fixed in a mine roof, an open ended sleeve adapted to receive said flexible tension member, said sleeve being able to be distorted into a wave pattern by applying oppositely directed transverse bending forces of sufficient amplitude to provide the substantially simultaneous functions of: (1) engagement of said flexible tension member fixedly within said sleeve and (2) applying a tensile force between said mounting devices by tensioning said flexible tension member.

2. A roof truss sling according to claim 1 wherein said sling consists of two flexible tension members each formed by a wire strand.

3. A roof truss sling according to claim 2 wherein said sleeve is a rolled hollow section sleeve.

4. A roof truss sling according to claim 3 wherein said mounting devices comprise U-shaped pipes engaging spaced roof bolts in said mine roof.

5. A method of trussing the roofs of mines comprising the following steps:

feeding at least one flexible tension member through an open ended sleeve, engaging said flexible tension member with at least two spaced mounting devices fixed in a mine roof, distorting said sleeve such that said tension member is fixedly engaged within said sleeve and the ends of said sleeve are drawn sufficiently closer together by said distortion having sufficient amplitude so as to apply a tensile force between said mounting device.

6. A method of trussing the roof of mines according to claim 5 wherein said flexible tension member comprises a wire strand.

7. A method of trussing the roofs of mines according to claim 6 wherein the open ended sleeve comprises a rolled section member.

8. A method of trussing the roofs of mines according to claim 7 wherein said mounting devices comprise U-shaped pipes engaging with spaced roof bolts in said mine roof.

9. A method of trussing the roofs of mines according to any one of claims 5–8 wherein said distortion is performed by applying oppositely directed transverse bending forces to said sleeve.

10. A method of trussing the roofs of mines according to claim 9 wherein said sleeve is distorted into a wave pattern.

11. A method of trussing the roofs of mines according to claim 9 wherein said strand is pinched during bending of said sleeve to prevent movement thereof relative to the sleeve.

12. A method of trussing the roofs of mines according to claim 5 wherein two or more wire strands are fed through said sleeve, each strand forming a said flexible tension member.

13. A roof truss sling for use in mines comprising: a pair of flexible tension members adapted to engage at least two spaced mounting devices fixed in a mine roof, an open ended sleeve adapted to receive said flexible tension members from opposite ends thereof, said sleeve being able to be distorted into a wave pattern by applying oppositely directed transverse bending forces of sufficient amplitude to provide the substantially simultaneous functions of: (1) engagement of said flexible tension member fixedly within said sleeve and (2) applying a tensile force between said mounting devices by tensioning said flexible tension member.

14. A method of trussing the roofs of mines comprising the following steps:

feeding two flexible tension members through opposing ends of an open ended sleeve, engaging each of said flexible tension members with one of two spaced mounting devices fixed in a mine roof, distorting said sleeve such that said tension member is fixedly engaged within said sleeve and the ends of said sleeve are drawn sufficiently closer together by said distortion having sufficient amplitude so as to apply a tensile force between said mounting devices without requiring the pretensioning of said flexible tension members.

* * * * *